United States Patent [19]

Merten et al.

[11] 4,453,771

[45] Jun. 12, 1984

[54] MINERAL WINNING PLOUGH WITH SWORD PLATE FORMED OF PLURAL PARTS

[75] Inventors: Gerhard Merten; Bernd Steinkuhl, both of Lunen; Oswald Breuer, Dortmund, all of Fed. Rep. of Germany

[73] Assignee: Gewerkschaft Eisenhutte Westfalia, Lunen, Fed. Rep. of Germany

[21] Appl. No.: 349,567

[22] Filed: Feb. 17, 1982

[30] Foreign Application Priority Data

Feb. 21, 1981 [DE] Fed. Rep. of Germany ..... 3106548

[51] Int. Cl.[3] ..... E21C 27/35

[52] U.S. Cl. ..... 299/34

[58] Field of Search ..... 299/32, 34

[56] References Cited

U.S. PATENT DOCUMENTS

| | | | |
|---|---|---|---|
| 3,291,531 | 12/1966 | Hauschopp | 299/34 |
| 4,025,117 | 5/1977 | Bahre et al. | 299/34 |

FOREIGN PATENT DOCUMENTS

| | | | |
|---|---|---|---|
| 1208270 | 1/1966 | Fed. Rep. of Germany . | |
| 1300889 | 5/1970 | Fed. Rep. of Germany . | |
| 2111224 | 9/1972 | Fed. Rep. of Germany . | |
| 197805 | 5/1978 | Fed. Rep. of Germany | 299/34 |
| 1440243 | 4/1966 | France | 299/34 |
| 589440 | 1/1978 | U.S.S.R. | 299/34 |

*Primary Examiner*—Ernest R. Purser

*Attorney, Agent, or Firm*—Sughrue, Mion, Zinn, Macpeak and Seas

[57] ABSTRACT

A mineral mining installation comprises a longwall scraper-chain conveyor, and a mineral winning plough. The plough is drivable to and fro along the face side of the conveyor by means of a plough drive chain and a three-part sword plate. The plough drive chain is housed in a chain guide attached to the goaf side of the conveyor. The sword plate is attached to the plough, and passes underneath the conveyor. Each pair of adjacent sword plate parts is detachable joined together by a pair of detachable pivot joints positioned respectively adjacent to the face and goaf sides of the conveyor.

13 Claims, 7 Drawing Figures

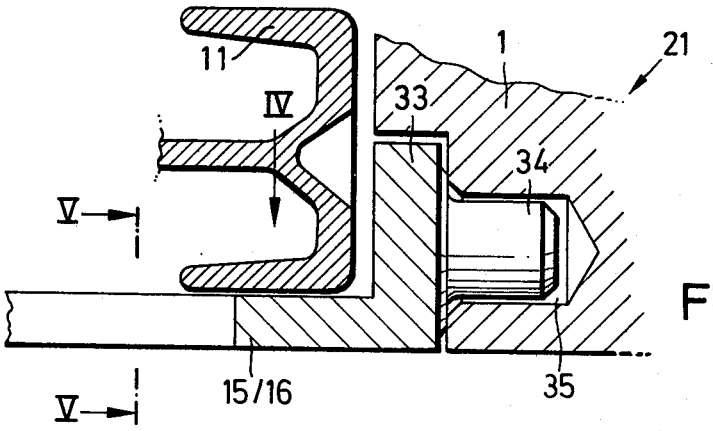
FIG. 3
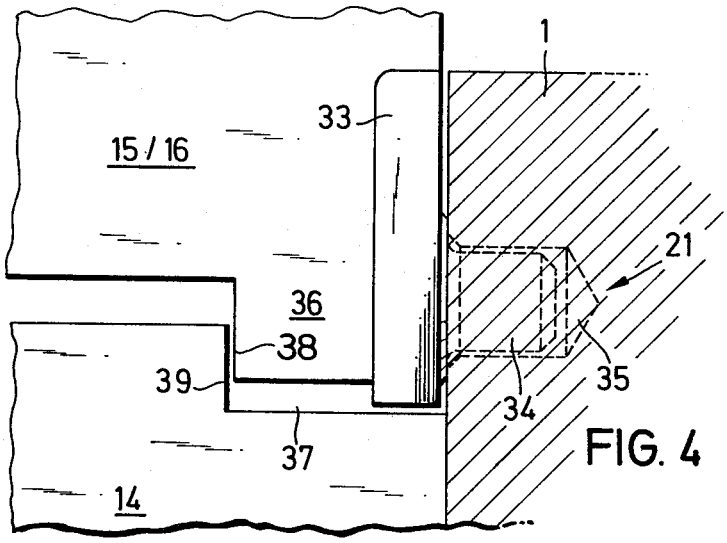
FIG. 4
FIG. 5
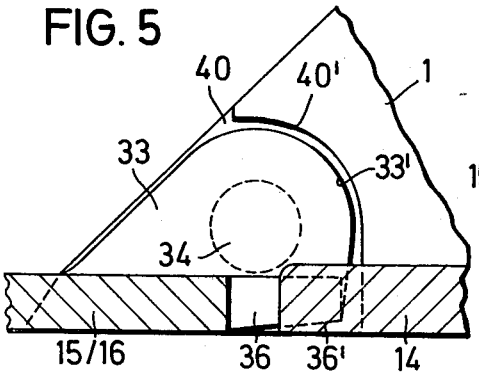
FIG. 6
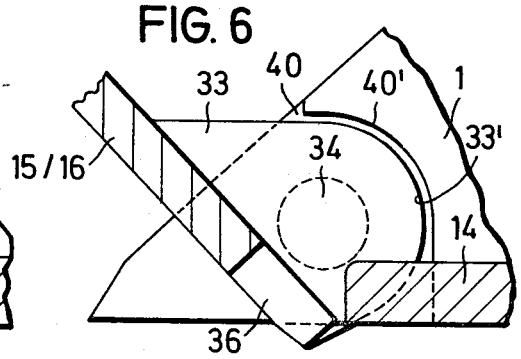

MINERAL WINNING PLOUGH WITH SWORD PLATE FORMED OF PLURAL PARTS

BACKGROUND TO THE INVENTION

This invention relates to a mineral winning plough having a multi-part sword plate.

Mineral winning ploughs having multi-part sword plates are well known (see, for example, DE-PS No. 1,208,270, DE-OS No. 1,300,889 and DE-PS No. 2,111,224). The sword plate of this known type of plough is usually of three-part construction, having two outer sword plate parts pivotally attached to a middle sword plate part. The pivotal connections between the sword plate parts permit relative pivoting therebetween in the plane perpendicular to both the seam and the floor of a longwall working along which the plough is reciprocably driven. The outer sword plate parts are provided with guide blocks which are guided within a chain guide provided at the goaf side of a conveyor which extends along the working, the plough being reciprocably driven along the face side of the conveyor. The guide blocks are attached to a plough drive chain housed within the chain guide, the sword plate passing underneath the conveyor.

The disadvantage of this known type of plough is that its sword plate, which is loaded by the weight of the conveyor, is subjected to considerable wear. The wear of the sword plate is concentrated in those regions which lie underneath the side walls of the conveyor. Unfortunately, the pivotal connections between the sword plate parts are located in these regions. Consequently, the pivotal connections are subjected to excessive wear, and this can lead to the complete destruction of the pivotal connections.

An object of the invention is to provide a plough having a multi-part sword plate having a strong and simple configuration at its pivotal connections.

Another object of the invention is to provide a plough having a multi-part sword plate whose pivotal connections are not subject to the excessive wear of the pivotal connections of known ploughs.

Yet another object of the present invention is to provide a plough having a multi-part sword plate, the parts of which are easy to assemble and dismantle.

SUMMARY OF THE INVENTION

The present invention provides in a mineral mining installation comprising a longwall conveyor and a mineral winning plough drivable to and fro along the face side of the conveyor by means of a plough drive chain and a multi-part sword plate, the drive chain being positioned at the goaf side of the conveyor, and the sword plate being attached to the plough and passing underneath the conveyor, the sword plate having at least one pair of adjacent parts, said at least one pair of adjacent sword plate parts being detachably joined together by a pivotal connection, the improvement comprising forming the pivotal connection by a pair of detachable pivot joints positioned respectively adjacent to the face and goaf sides of the conveyor.

With this configuration of the multi-part sword plate, all the pivot joints lie outboard of the conveyor, and not beneath the conveyor. Consequently, the pivot joints do not lie in those regions of the sword plate which are subjected to the greatest wear. Moreover, the pivot joints are more readily accessible than the corresponding joints of the known types of plough sword plate.

This is particularly true of the goaf-side pivot joint(s) which is (or are) situated in the chain guide provided at the goaf side of the conveyor. Thus, access to the goaf-side pivot joint(s) is easily gained by disengagement of a section of the chain guide, or by driving the plough out of the guide at the end of the longwall working. Furthermore, the pivot joints (particularly the goaf-side pivot joint(s)) can be made especially strong, so that they can transmit the high traction forces of the plough drive chain.

In a preferred embodiment, the sword plate has three parts, namely a middle sword plate part and two outer sword plate parts, and wherein the middle sword plate part is detachably joined to each of the outer sword plate parts by a respective pivotal connection, each pivotal connection comprising a pair of detachable pivot joints positioned respectively adjacent to the face and goaf sides of the conveyor.

Advantageously, each of the pivot joints is positioned above the plane of that portion of the sword plate which passes underneath the conveyor.

Preferably, each face-side pivot joint is a pin-and-aperture joint; and each goaf-side pivot joint includes a connector having first and second chain links, the first chain link engaging over a hook-shaped coupler provided on one of the associated sword plate parts, and the second chain link engaging over a coupler provided on the other associated sword plate part, the second chain link being fixed to the coupler of the other associated sword plate part by means of a detachable locking member. Conveniently, the connector of each goaf-side pivot joint includes a third chain link positioned between, and joined to, the first and second chain links, and wherein a spacer is attached to the third chain link. Advantageously, the spacer is of two-part construction, the two spacer parts being welded together to trap the third link therebetween. Conveniently, each coupler of each goaf-side pivot joint forms part of a respective guide block attached to the respective sword plate part, the guide blocks engaging within a chain guide provided at the goaf side of the conveyor.

One sword plate part of each adjacent pair of sword plate parts may be formed with an axial projection which is engageable with a complementary recess formed in the other sword plate part of said pair of sword plate parts. Advantageously, said projections and said recesses are positioned on the face side of the sword plate parts adjacent to the face-side pivot joints, and the underneath side of each of said projections tapers towards its free end. Preferably, the sword plate is so constructed that the engagement between a given projection and its complementary recess can be eliminated by relative pivoting of the two corresponding sword plate parts.

Advantageously, each of the outer sword plate parts is provided, at the face side thereof, with an upwardly-extending flange, and wherein each of said flanges is provided with a pin which forms part of one of said pin-and-aperture joints. In this case, the plough may have a plough body, the middle sword plate may be fixed to the plough body, and the plough body may be formed with a respective aperture for each of said pins, said apertures each forming part of one of said pin-and aperture joints.

BRIEF DESCRIPTION OF THE DRAWINGS

A mineral winning plough having a sword plate and constructed in accordance with the invention will now be described, by way of example, with reference to the accompanying drawings in which:

FIG. 3 is a cross-section taken on the line III—III of FIG. 2, and shows a face-side joint interconnecting two sword plate parts;

FIG. 4 is a view looking in the direction of the arrow IV of FIG. 3;

FIG. 5 is a cross-section taken on the line V—V of FIG. 3;

FIG. 6 is a cross-section similar to that of FIG. 5, but shows the sword plate parts in different positions.

DESCRIPTION OF PREFERRED EMBODIMENT

Figure 1:
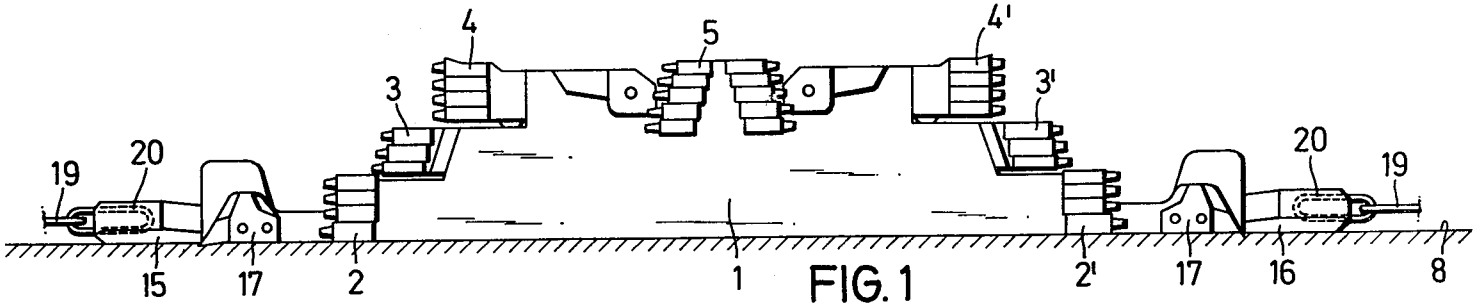
FIG. 1 is a diagrammatic side elevation of the plough, as seen from the mineral face being won by the plough.
Figure 2:
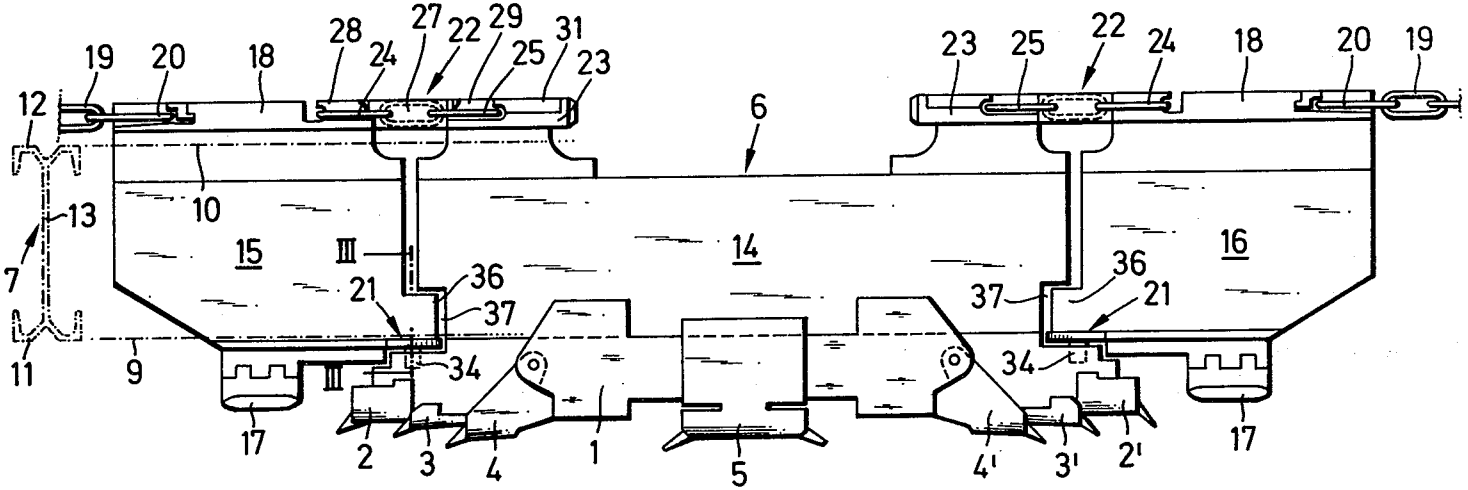
FIG. 2 is a plan view of the plough shown in FIG. 1.

Referring to the drawings, FIG. 1 shows a mineral winning plough having a plough body 1. The plough body 1 is provided with sets of cutters 2, 3 and 4, and 2', 3' and 4' arranged symmetrically at its ends. A further set of cutters 5 is provided at the top of the plough body 1 in the middle, this set of cutters being for winning mineral material (for example coal) from the upper part of a seam. The plough is provided with a sword plate 6, the sword plate being attached to the plough body 1 and passing underneath a scraper-chain conveyor 7 extending along a longwall working. In known manner, the scraper-chain conveyor 7 includes a plurality of channel sections joined together end-to-end. The conveyor 7 is not shown in FIG. 1, but one of its channel sections is schematically shown in FIG. 2, where the channel section is shown turned through 90° to face into the floor 8 of the working, and where the dash-dot lines 9 and 10 indicate the lateral edges of the conveyor. Each of the conveyor channel sections has a face-side side wall 11, a goaf-side side wall 12, and a floor plate welded between the two side walls.

The sword plate 6 is of multi-part construction, having a middle part 14 and two outer parts 15 and 16. Each of the outer sword plate parts 15 and 16 is provided with a floor-level cutter 17 at the face side thereof, the cutter 17 being used to limit the depth of cut of the plough. The goaf side of each of the outer sword plate parts 15 and 16 is provided with a respective guide block 18, the guide blocks being guided, in a known manner, within a plough chain guide (not shown) comprising a plurality of ramp-like guide sections attached to the goaf side of the conveyor 7. A plough drive chain 19 is attached, at 20, to each of the guide blocks 18.

The outer sword plate parts 15 and 16 are each detachably connected to the middle sword plate 14, for pivotal movement about an axis which is substantially parallel to the floor 8 of the working and perpendicular to the longitudinal axis of the conveyor 7. The detachable connections between the two outer sword plate parts 15 and 16 and the middle sword plate part 14 are identical, each having a face-side pivot joint 21 and a goaf-side pivot joint 22. As shown in FIG. 2, the pivot joints 21 lie on the face side of the face-side side walls 11 of the conveyor channel sections, and the pivot joints 22 lie on the goaf side of the goaf-side side walls 12. Each of the pivot joints 22 connects the guide block 18 of the respective outer sword plate part 15 or 16 to a guide block 23 attached to the middle sword plate part 14.

Figure 7:
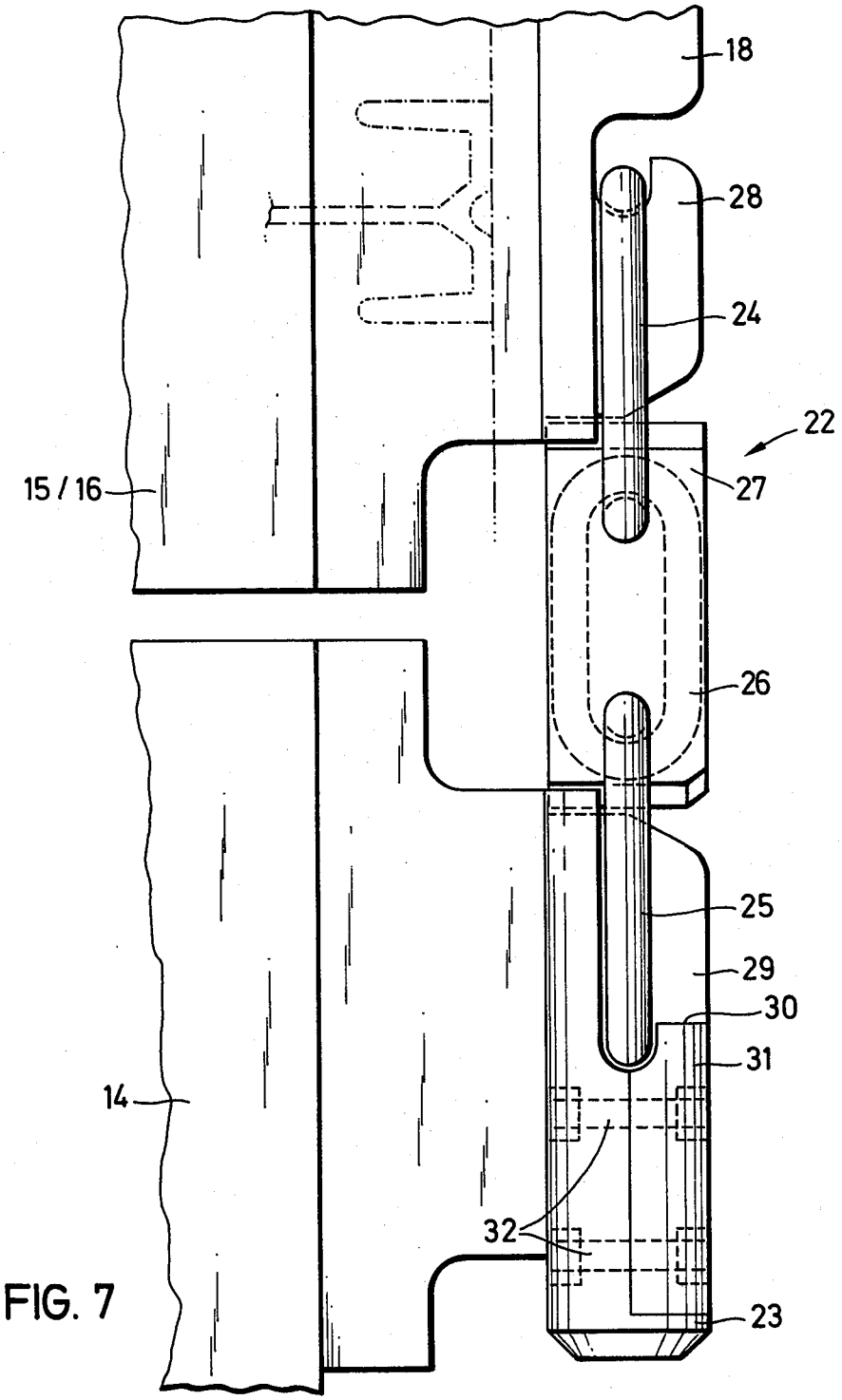
FIG. 7 is an enlarged plan view of part of the plough sword plate, and shows a goaf-side joint interconnecting two sword plate parts.

One of the goaf-side pivot joints 22 is shown in detail in FIG. 7. Each pivot joint 22 includes a connector for detachably connecting the respective pair of guide blocks 18 and 23, the connector comprising a short length of chain having three links 24, 25 and 26. The outer links 24 and 25 of each connector are positioned substantially vertically, and the central link 26 of that connector is positioned substantially horizontally. Each horizontal link 26 carries a spacer 27 which is made from a pair of complementary spacer elements. The two spacer elements of each spacer 27 are formed with link-shaped grooves (not shown), into which the associated link 26 fits. The two spacer elements are then welded together around the link 26. The spacers 27 hold the sword plate parts 14 and 15, and 15 and 16 apart so that their facing edges are at a predetermined, small spacing; the ends of the spacers bearing against the corresponding guide blocks 18 and 23. Each guide block 18 is formed with a hook-shaped coupler 28, onto which the respective link 24 can be hung from the side. The other guide blocks 23 each form a peg-shaped coupler 29 around which the respective link 25 engages. The links 25 are held in place around their couplers 29 by locking members 31. Each locking member 31 is detachably fixed in an aperture 30 in its guide block 23 by screw-threaded members 32.

The pivot joints 22 permit the sword plate parts 14, 15 and 16 to pivot relative to one another in the plane perpendicular to the floor 8 and to the seam. They also permit a small degree of transverse displacement and pivotability in the plane parallel to the floor 8.

In order to assemble a pivot joint 22, its link 24 is hung (from the side) on the hook-shaped coupler 28 of the respective guide block 18. The spacer 27 of that pivot joint 22 is then laid between the couplers 28 and 29 of the associated guide blocks 18 and 23. Then, the link 25 is pivoted (from the side) over and around the coupler 29, whereupon the locking member 31 is inserted into its aperture 30 and fixed by its screw-threaded members 32.

FIGS. 3 to 6 show one of the pivot joints 21 in detail. Thus, each of the outer sword plate parts 15 and 16 is formed with an upwardly-extending flange 33, these flanges being positioned at the face-side edges of the parts 15 and 16, and lying adjacent to the face-side side wall 11 of a respective conveyor channel section. Each of the flanges 33 carries a horizontal pin 34, which protrudes transversely with respect to the longitudinal axis of the conveyor 7. Each pin 34 engages, with a small, predetermined amount of play, within a complementary aperture 35 formed in the plough body 1; each pin/aperture combination defining one of the pivot joints 21, as the middle sword plate part 14 is fixed to the plough body. As shown best in FIG. 3, the pivot joints 21 are positioned above the main portion of the sword plate 6. Each of the outer sword plate parts 15 and 16 is provided with an axial projection 36, the axial projections being positioned adjacent to their respective pins 34, and at the face-side edges of their parts 15 and 16. Each of the projections 36 engages within a complementary recess 37 formed in the adjacent edge portion of the middle sword plate 14. The longitudinal edges 38 and 39 respectively of the projections 36 and the recess 37 abut one another to provide transverse support for the sword plate parts 14, 15 and 16.

As shown in FIGS. 5 and 6, the upper portions 33' of the flanges 33 are of arcuate form. The flanges 33 lie within lateral apertures 40 formed in the plough body 1, these apertures having correspondingly shaped arcuate upper regions 40'.

In order to dismantle the sword plate 6, by removing the outer sword plates 15 and 16 from the middle sword plate part 14, the pivot joints 22 must first be disengaged. In order to do this, their locking members 31 are released by removing their screw-threaded members 32. The links 25 can then be pivoted sideways away from their couplers 29, whereupon the spacers 27 can be removed from between their respective guide blocks 18 and 23. The links 24 can then be detached from their couplers 28. After release of the pivot joints 22, the outer sword plate parts 15 and 16 can be pivoted upwards through about 45° (see FIG. 6) with respect to the middle sword plate part 14. This pivoting movement of the outer sword plate parts 15 and 16 brings their axial projections 36 out of engagement with the recesses 37 in the plough body 1, so that the outer sword plate parts can be moved towards the goaf side in order to remove their pins 34 from the recesses 35. This releases the pivot joints 21, so that the outer sword plate parts 15 and 16 are completely separated from the middle sword plate part 14. In order to facilitate the pivotal movement of the outer sword plate parts 15 and 16, their projections 36 are formed with bevelled surfaces 36' on the underneath.

Assembly of the sword plate 6 takes place by reversing the steps described above. Obviously, during dismantling or assembly of the sword plate 6, the conveyor 7 must be raised. Alternatively, the plough must be moved beyond one end of the conveyor 7 so as to expose the sword plate 6.

We claim:

1. In a mineral mining installation including a longwall conveyor and a mineral winning plough drivable to and fro along the face side of the conveyor by means of a plough drive chain and a multi-part sword plate, the drive chain being positioned at the goaf side of the conveyor, the sword plate being attached to the plough and passing underneath the conveyor, the sword plate having at least one pair of adjacent parts, and said at least one pair of adjacent sword plate parts being detachably joined together by a pivotal connection, the improvement comprising: forming the pivotal connection by a pair of detachable pivot joints positioned respectively adjacent to the face and goaf sides of the conveyor, each goaf-side pivot joint including a connector having first and second chain links, the first chain link engaging over a hookshaped coupler provided on one of the associated sword plate parts, and the second chain link engaging over a coupler provided on the other associated sword plate part, the second chain link being fixed to the coupler of the other associated sword plate part by means of a detachable locking member.

2. A mineral winning plough according to claim 1, wherein the connector of each goaf-side pivot joint includes a third chain link positioned between, and joined to, the first and second chain links, and wherein a spacer is attached to the third chain link.

3. A mineral winning plough according to claim 1, wherein the spacer is of two-part construction, the two spacer parts being welded together to trap the third link therebetween.

4. A mineral winning plough according to claim 1, wherein each coupler of each goaf-side pivot joint forms part of a respective guide block attached to the respective sword plate part, the guide blocks engaging within a chain guide provided at the goaf side of the conveyor.

5. A mineral winning plough according to claim 1, wherein the sword plate has three parts, namely a middle sword plate part and two outer sword plate parts, and wherein the middle sword plate part is detachably joined to each of the outer sword plate parts by a respective pivotal connection, each pivotal connection comprising a pair of detachable pivot joints positioned respectively adjacent to the face and goaf sides of the conveyor.

6. A mineral winning plough according to claim 5, wherein each of the pivot joints is positioned above the plate of that portion of the sword which passes underneath the conveyor.

7. A mineral winning plough according to claim 5, wherein each face-side pivot joint is a pin-and-aperture joint.

8. A mineral winning plough according to claim 7, wherein each of the outer sword plate parts is provided, at the face side thereof, with an upwardly-extending flange, and wherein each of said flanges is provided with a pin which forms part of one of said pin-and-aperture joints.

9. A mineral winning plough according to claim 8, wherein the plough has a plough body, and the middle sword plate part is fixed to the plough body, and wherein the plough body is formed with a respective aperture for each of said pins, said apertures each forming part of one of said pin-and-aperture joints.

10. A mineral winning plough according to claim 5, wherein one sword plate part of each adjacent pair of sword plate parts is formed with an axial projection which is engageable with a complementary recess formed in the other sword plate part of said pair of sword plate parts.

11. A mineral winning plough according to claim 10, wherein said projections and said recesses are positioned on the face side of the sword plate parts adjacent to the face-side pivot joints.

12. A mineral winning plough according to claim 10, wherein the sword plate is so constructed that the engagement between a given projection and its complementary recess can be eliminated by relative pivoting of the two corresponding sword plate parts.

13. A mineral winning plough according to claim 10, wherein the underneath side of each of said projections tapers towards its free end.

* * * * *